US010943514B1

(12) United States Patent
O'Keefe et al.

(10) Patent No.: US 10,943,514 B1
(45) Date of Patent: Mar. 9, 2021

(54) NONDESTRUCTIVE WEARABLE AND DETACHABLE DISPLAY ASSEMBLY

(71) Applicants: Michael Frank O'Keefe, Farmington, UT (US); Christopher Allen Poenisch, Farmington, UT (US)

(72) Inventors: Michael Frank O'Keefe, Farmington, UT (US); Christopher Allen Poenisch, Farmington, UT (US)

( * ) Notice: Subject to any disclaimer, the term of this patent is extended or adjusted under 35 U.S.C. 154(b) by 0 days.

(21) Appl. No.: 16/891,356

(22) Filed: Jun. 3, 2020

Related U.S. Application Data

(60) Provisional application No. 62/857,738, filed on Jun. 5, 2019.

(51) Int. Cl.

| | |
|---|---|
| ***G09F 3/20*** | (2006.01) |
| ***A44C 3/00*** | (2006.01) |
| ***G09F 7/10*** | (2006.01) |
| ***G09F 7/18*** | (2006.01) |

(52) U.S. Cl.
CPC ..... *G09F 3/207* (2013.01); *A44C 3/001* (2013.01); *G09F 7/10* (2013.01); *G09F 7/18* (2013.01); *G09F 2007/1852* (2013.01)

(58) Field of Classification Search
CPC ... G09F 3/207; G09F 7/10; G09F 7/18; G09F 2007/1852; G09F 21/023; A44C 3/001
See application file for complete search history.

(56) References Cited

U.S. PATENT DOCUMENTS

| | | | | | |
|---|---|---|---|---|---|
| 4,236,331 | A | * | 12/1980 | Mattson | A44C 3/001 40/1.5 |
| 5,067,265 | A | | 11/1991 | Harms | |
| 5,283,966 | A | * | 2/1994 | Rader | A44C 3/001 40/1.5 |
| 5,369,899 | A | * | 12/1994 | Reeves | A44C 3/001 24/303 |
| 5,504,976 | A | * | 4/1996 | Reeves | A44C 3/001 24/3.1 |
| 5,740,557 | A | | 4/1998 | Reid et al. | |
| 6,006,455 | A | * | 12/1999 | Miller | G09F 7/04 40/1.6 |
| 6,085,393 | A | | 7/2000 | Tsui et al. | |
| 6,175,963 | B1 | | 1/2001 | Loeffelholz | |
| 6,260,749 | B1 | | 7/2001 | Horovitz | |
| 6,282,760 | B1 | | 9/2001 | Mars | |
| 6,339,866 | B1 | | 1/2002 | French | |

(Continued)

*Primary Examiner* — Gary C Hoge
(74) *Attorney, Agent, or Firm* — John Rizvi; John Rizvi, P.A.-The Patent Professor

(57) ABSTRACT

A display assembly supports a display item in a visually prominent orientation and is removably attachable to an article of clothing in a nondestructive manner. The display assembly includes a docking assembly removably attached to the article of clothing and having a base unit with one or more dock interconnects and a display interconnect, and a docking unit having one or more base interconnects. A display unit includes a display holder having a display chamber dimensioned to support the display item in the visually prominent orientation. The display unit also includes a docking interconnect, wherein the display unit is attachable to and detachable from the docking assembly with a single hand of the user via an operative engagement of the docking interconnect with the display interconnect of the docking assembly.

20 Claims, 7 Drawing Sheets

(56) References Cited

U.S. PATENT DOCUMENTS

| | | | | |
|---|---|---|---|---|
| 6,446,372 | B1 * | 9/2002 | Reeves | A44C 3/001 24/303 |
| 6,671,986 | B2 | 1/2004 | Reeves | |
| 6,684,544 | B1 * | 2/2004 | Buettell | G09F 7/04 40/1.5 |
| 7,243,377 | B2 | 7/2007 | Ashy | |
| 8,065,825 | B2 | 11/2011 | Peterson et al. | |
| 8,314,672 | B2 | 11/2012 | Fullerton et al. | |
| 8,453,265 | B2 | 6/2013 | Forte et al. | |
| 8,793,846 | B2 | 8/2014 | d'Auriac | |
| 9,105,380 | B2 | 8/2015 | Roberts et al. | |
| 9,339,090 | B1 | 5/2016 | Renegar | |
| 9,392,848 | B2 | 7/2016 | LeBlanc | |
| 10,165,811 | B2 | 1/2019 | O'Leary | |
| 10,575,423 | B2 | 2/2020 | DiMeglio | |
| 2004/0237262 | A1 | 12/2004 | Arnone | |
| 2007/0186390 | A1 | 8/2007 | Johnston | |
| 2009/0044430 | A1 | 2/2009 | Philpott | |
| 2011/0047838 | A1 * | 3/2011 | Peterson | G09F 3/207 40/1.5 |
| 2014/0044910 | A1 | 2/2014 | Shi | |
| 2014/0259298 | A1 * | 9/2014 | Esagoff | A44C 3/001 2/251 |
| 2015/0223588 | A1 | 8/2015 | DeNittis et al. | |
| 2016/0120271 | A1 * | 5/2016 | Renegar | A44B 99/00 24/303 |
| 2019/0096289 | A1 * | 3/2019 | Harkness | G08B 21/02 |

* cited by examiner

NONDESTRUCTIVE WEARABLE AND DETACHABLE DISPLAY ASSEMBLY

CROSS-REFERENCE TO RELATED APPLICATIONS

This application claims the benefit of U.S. Provisional Patent Application Ser. No. 62/857,738 filed on Jun. 5, 2019, which is incorporated by reference herein in its entirety.

FIELD OF THE INVENTION

The present invention relates generally to a display assembly configured to be attached to an article of clothing in a nondestructive manner, and further, the display assembly includes a display unit which is quickly and easily attachable to and detachable from a docking assembly, which remains removably secured to the article of clothing.

BACKGROUND OF THE INVENTION

Permanent identification badges for employees and personnel are required to be displayed on a person or a person's clothing in a wide variety of work environments. Some permanent identification badges are for security purposes, while others are merely for name identification purposes. In many cases, these badges are attached to a person's clothing, or onto the person themselves, utilizing a device that either attaches mechanically to the person's clothing, or hangs or is otherwise secured to a portion of the person's body. A number of devices have been developed in attempts to properly display on identification badge on a person or a person's clothing, but none are fully satisfactory, for the reasons stated in more detail below.

Perhaps the most common identification badge display devices are mechanical attachment devices which include such things as alligator clips, cantilever clamps and/or safety pins. While these devices are effective for securing an identification badge onto a person's clothing, repeated use generally results in premature wear or destruction of the garment to which they are attached. In addition, these mechanical attachment devices are often difficult to attach to clothing in a manner that prominently displays the identification badge relative to the person wearing the badge. Specifically, such devices tend to sag or pull on the clothing, causing undesirable deformation of the garment being worn. Further, such devices can ultimately destroy the garment being worn as they can tear or fray the fabric if the badge catches or snags on a stationary object. In addition, many of these devices have a tendency to allow the identification badge to flip over displaying the back of the badge instead of the front of the badge, which includes the required identification information. Also, none of these known mechanical attachment devices allow for the quick removal and reattachment of an identification badge when required to present it to a security officer or electronic badge reader. More in particular, most, if not all, of these mechanical attachment devices require the use of both hands to attach, remove or reattach, and properly position on the person's clothing. This creates a problem when a person wearing the badge is holding something in one of both of his or her hands.

Other devices include neck lanyards and armband type devices which are generally designed to utilize a person's neck or arm to provide an attachment point for the identification badge, however, they have a number of drawbacks as well. Neither the neck lanyard nor the armband type devices display the identification badge at the appropriate position in the upper right or left chest area, as is required for most identification badges. Further, the neck lanyard does not reliably display the front of the identification badge because it is free to rotate and display the back side of the badge at random. Perhaps the biggest drawback of the neck lanyard is the tendency for it to rotate away from the body when the person is leaning over, which allows it to drag over surfaces and frequently snag on objects. More importantly, if a neck lanyard does not have a breakaway feature they can be dangerous, as the person wearing the neck lanyard can be choked or strangled if the neck lanyard is caught in moving machinery or on a stationary object which the person is moving past. While a neck lanyard does permit ease of presentation of the badge to a security officer or electronic badge reader, the arm band device does not. Specifically, a person must either remove the identification badge from the armband, or remove the armband altogether, either of which typically requires the use of both hands. As before, this is a problem when a person wearing the badge is holding something in one of both of his or her hands.

Also known are devices which utilize a two piece magnetic system. More in particular, one of the magnetic pieces is attached permanently to an identification badge itself, while another backing magnetic piece is placed on the inside of a portion of the person's clothing, such as a shirt or blouse. Although these devices do not generally damage the clothing, they still do not allow for the quick removal of the identification badge for presentation to a security officer or electronic badge reader. Specifically, when the magnetic piece to which the badge is permanently attached is detached from the other backing magnetic piece of the magnetic system, unless held in place by one hand of the user, the backing magnetic piece that is placed on the inside of the garment next to the skin will fall to the waist line or possibly even to the ground when the magnetic piece to which the badge is attached is removed for presentation. When this happens, reattaching the badge generally requires the loosening of articles of clothing to retrieve and reposition the backing magnetic piece backing such that the identification badge may be reattached. Once again, this is a problem when a person wearing the badge is holding something in one of both of his or her hands.

Self-sticking identification badges having an adhesive material on one side are most often associated with temporary or one-time use identification badges. These badges are generally issued in areas or venues such as conventions, hospitals and hospitality events. The adhesive used is generally clothing safe, however, adequate adhesion is typically difficult to achieve, even after a short period of use, and depending on the type or texture of the fabric worn, it may never properly adhere to the clothing. These adhesive secured badges have a tendency to roll up around the edges and eventually are inadvertently or intentionally removed, such as by becoming stuck to another portion of the wearer's clothing, such as an arm or sleeve, or simply falling off altogether.

Accordingly, there is an established need for a device which resolves one or more of the foregoing problems when an item, such as an identification badge, must be displayed on or about a user's clothing.

SUMMARY OF THE INVENTION

The present invention is directed to a display assembly configured to be attached to an article of clothing in a nondestructive manner, wherein the display assembly includes a display unit which is quickly and easily attachable to and detachable from a docking assembly, which remains removably secured to the article of clothing.

In a first implementation of the invention, a display assembly supports at least one display item in a visually prominent orientation and is removably attachable to an article of clothing worn by a user in a nondestructive manner, the article of clothing having an inner surface and an outer surface, the display assembly comprising a docking assembly comprising a base unit having at least one dock interconnect and at least one display interconnect; the docking assembly further comprising a docking unit having at least one base interconnect; the docking assembly removably attached to the article of clothing in the nondestructive manner via an operative alignment of the at least one dock interconnect and the at least one base interconnect; a display unit comprising a display holder having a display chamber dimensioned to support the at least one display item in the visually prominent orientation, and the display unit also including at least one docking interconnect, wherein the display unit is attachable to and detachable from the docking assembly with a single hand of the user via an operative engagement of the at least one docking interconnect with the at least one display interconnect of the docking assembly.

In a second aspect, one or more of the dock interconnects and/or the base interconnects can include a magnetic material of construction.

In another aspect, one or more of the display interconnects and/or the docking interconnects may include a magnetic material of construction.

In one further aspect, a display unit of a display assembly may have a display alignment member disposed around at least a portion of a docking interconnect, wherein the display alignment member comprises a geometric configuration.

In yet one other aspect, a docking aperture of a docking assembly can include a display alignment guide channel having a complementary geometric configuration dimensioned to receive a display alignment member therein in one or more aligned configurations.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front". "vertical". "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a display assembly configured to be attached to an article of clothing in a nondestructive manner, wherein the display assembly includes a display unit which is quickly and easily attachable to and detachable from a docking assembly, which remains removably secured to the article of clothing, using a single hand.

Figure 8:
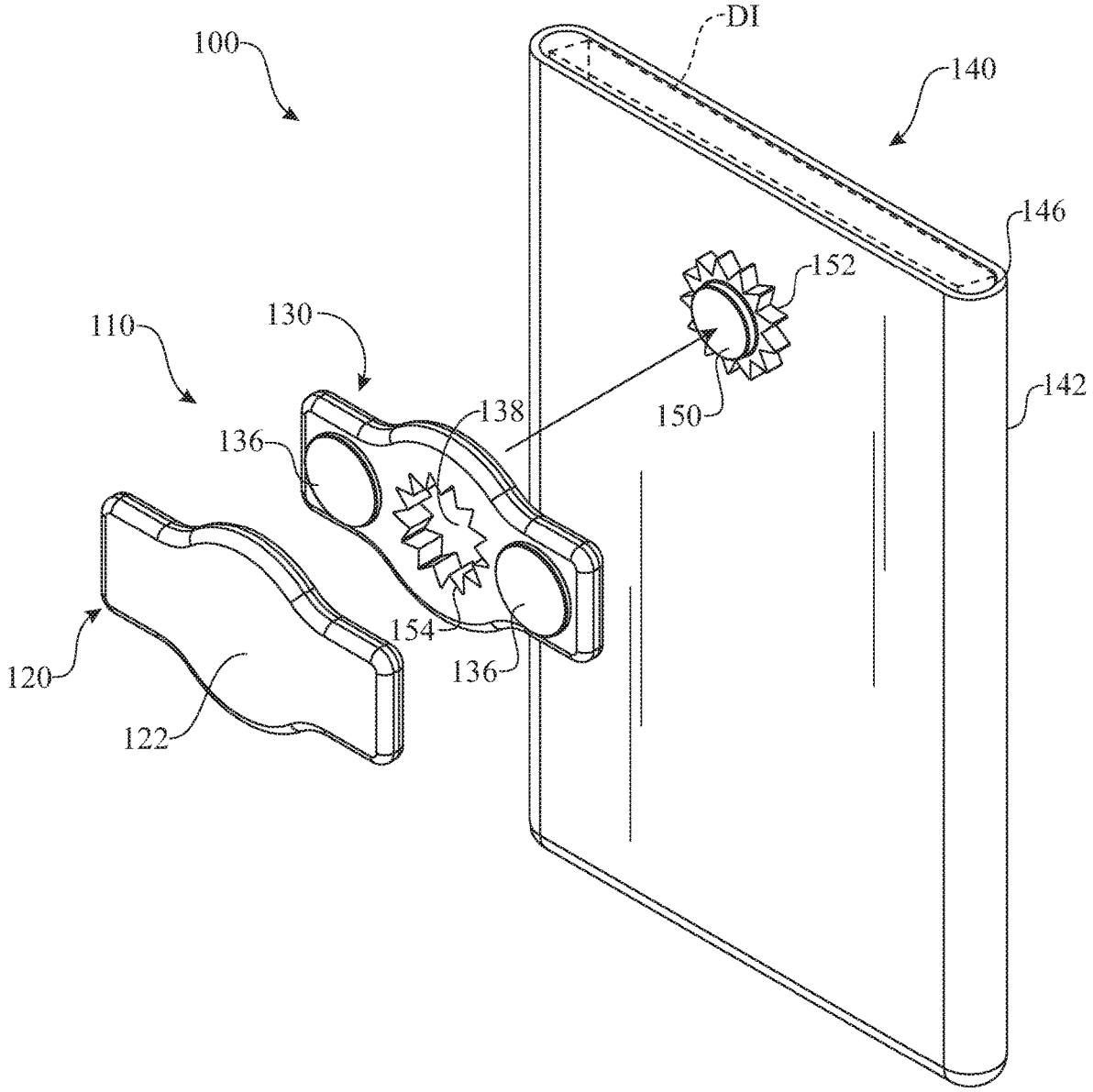
FIG. 8 presents an exploded rear perspective view of one illustrative embodiment of a nondestructive wearable detachable display assembly, in accordance with the present invention.
Figure 9:
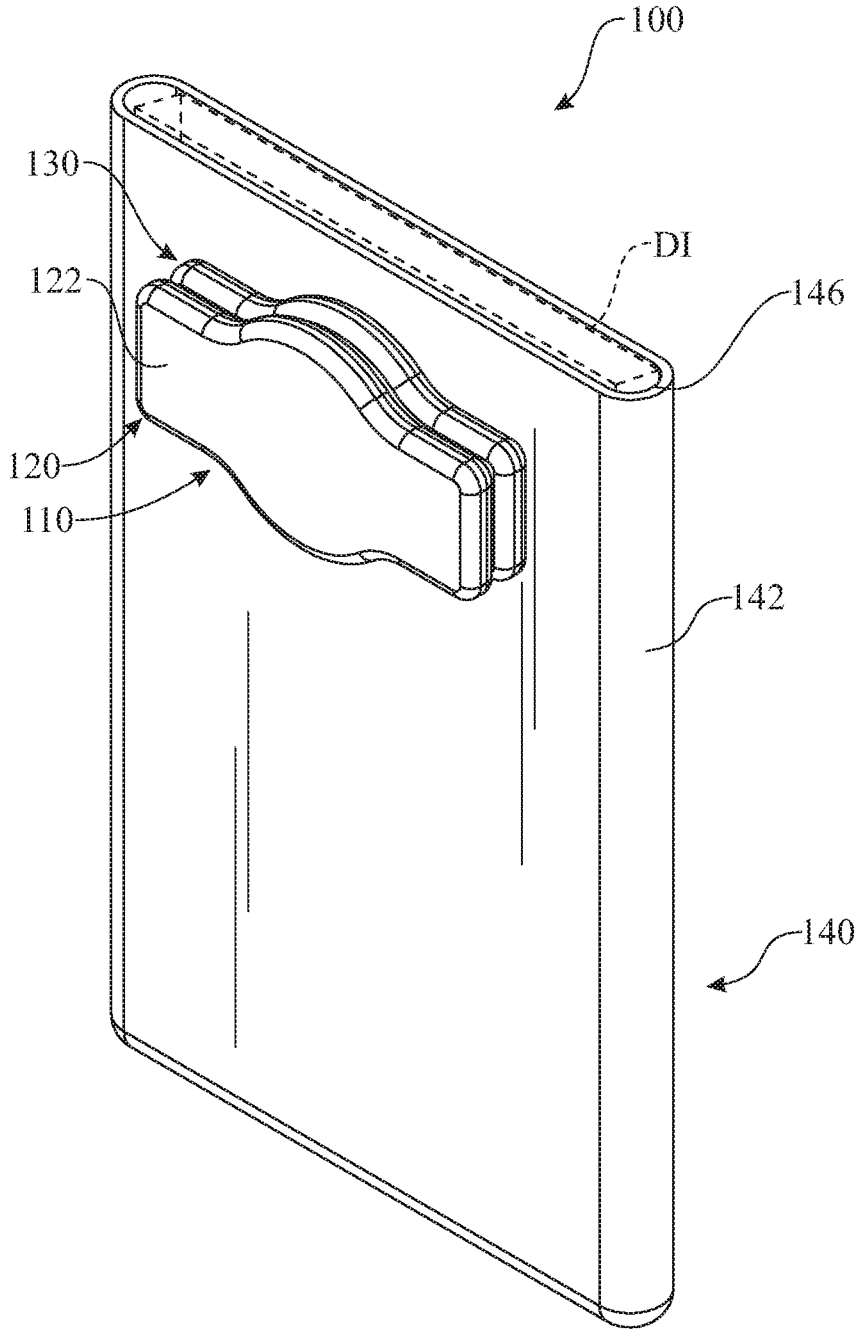
FIG. 9 presents a rear perspective view of the nondestructive wearable detachable display assembly of FIG. 8 showing the display unit disposed in an operative engagement with the docking assembly, in accordance with the present invention.
Figure 10:
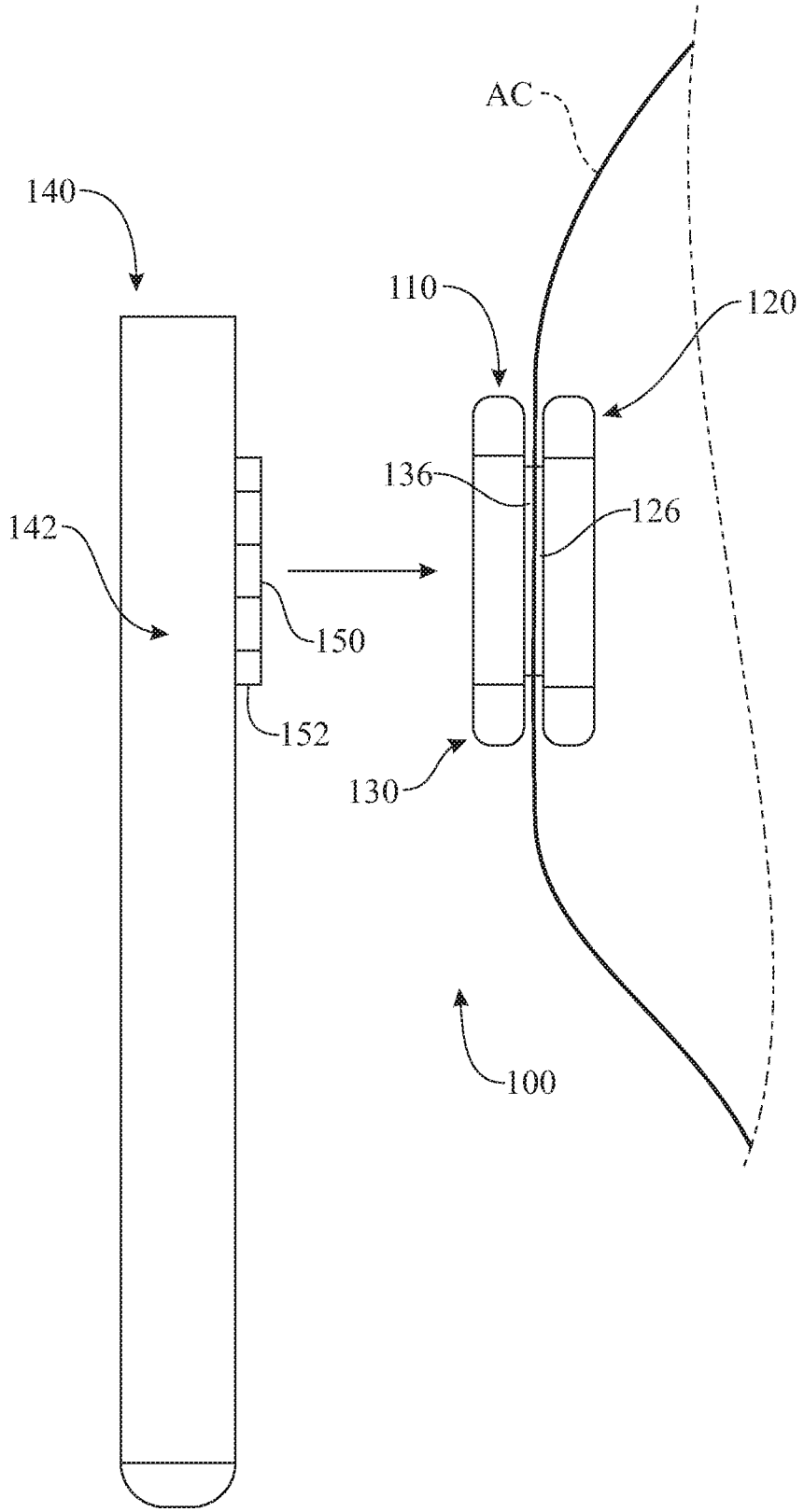
FIG. 10 presents a partially exploded side elevation of one illustrative embodiment of a nondestructive wearable detachable display assembly showing a docking assembly attached to a portion of an article of clothing in a nondestructive manner via an operative alignment of at least one dock interconnect of a base unit and at least one base interconnect of a docking unit, in accordance with the present invention.

Referring initially to FIGS. 8 through 10, the present invention is directed to a nondestructive wearable detachable display assembly generally as shown as at 100 in the figures. More in particular, FIG. 8 is representative of an exploded perspective view of one illustrative embodiment of a nondestructive wearable detachable display assembly 100 having a docking assembly 110 and the display unit 140, in accordance with the present invention. With reference to FIG. 9, a perspective view is presented of the nondestructive wearable detachable display assembly 100 of FIG. 8, showing a display unit 140 disposed in an operative engagement with a docking assembly 110, as discussed in greater detail hereinafter.

Figure 1:
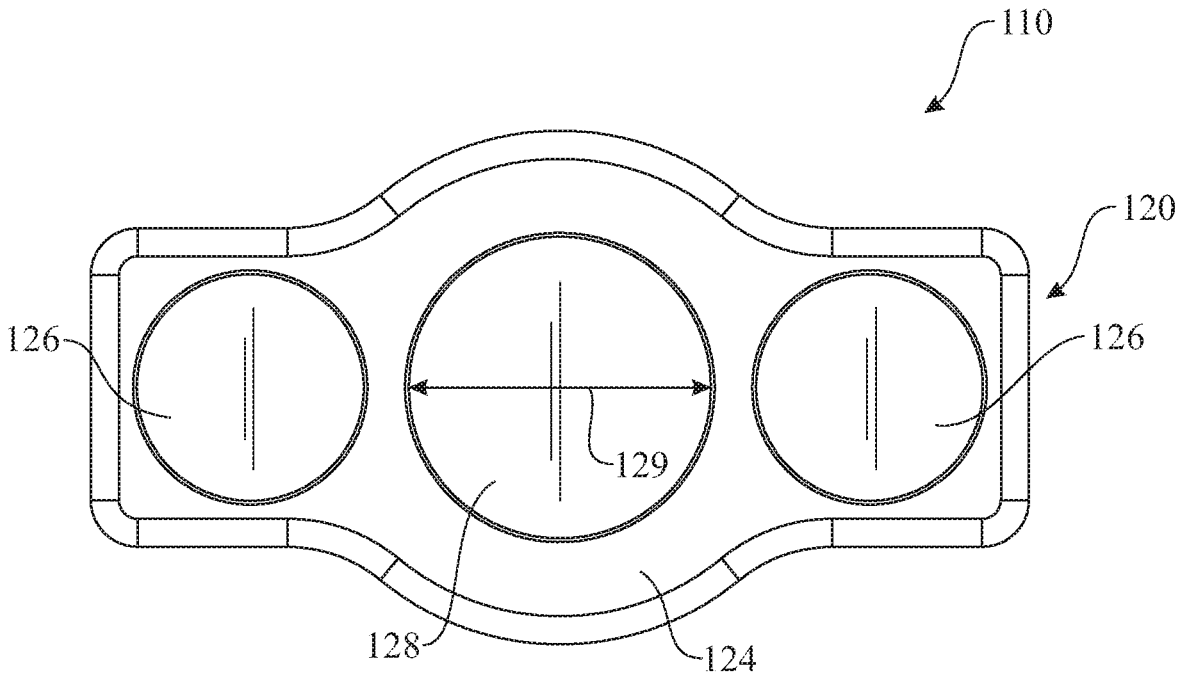
FIG. 1 presents an elevation of one illustrative embodiment of a base unit showing an active base surface, in accordance with the present invention.
Figure 2:
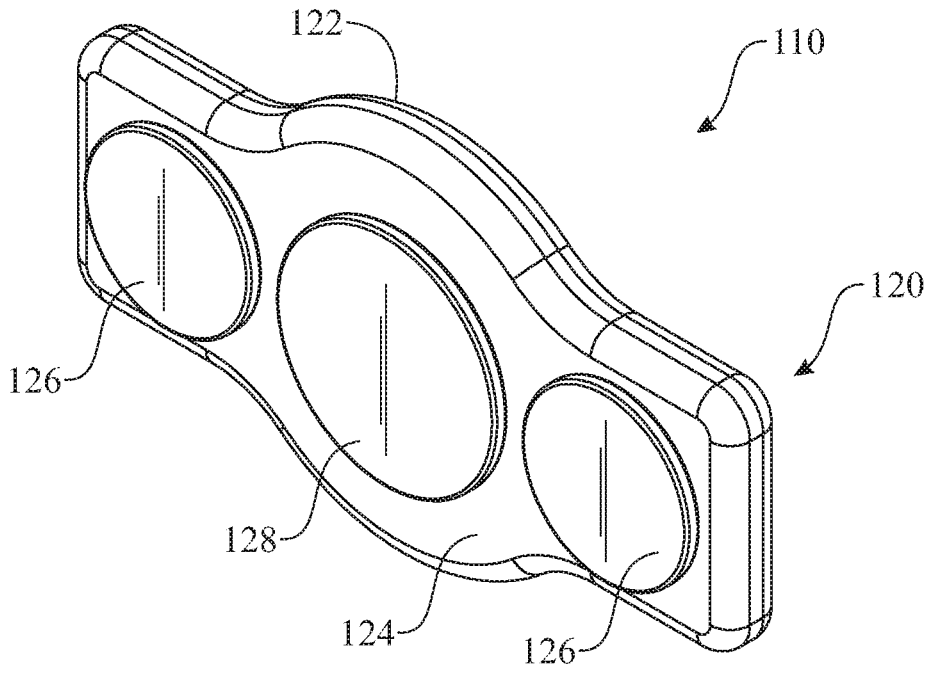
FIG. 2 presents a perspective view of the base unit of FIG. 1, in accordance with the present invention.

Looking next to FIGS. 1 and 2, a base unit 120 of the docking assembly 110 in accordance with at least one embodiment of the present invention is shown. More in particular, each of FIGS. 1 and 2 show a base unit 120 having an active base surface 124 displayed therein. Looking once again to the illustrative embodiment of FIGS. 8 and 9, a base unit 120 further comprises a shielded base surface 122. A base units 120 in accordance with the present invention comprises at least one dock interconnect 126 and at least one display interconnect 128 affixed thereto. As shown in FIGS. 1 and 2, a base unit 120 in accordance with at least one embodiment of the present invention comprises a plurality of dock interconnects 126 affixed to an active base surface 134.

Figure 3:
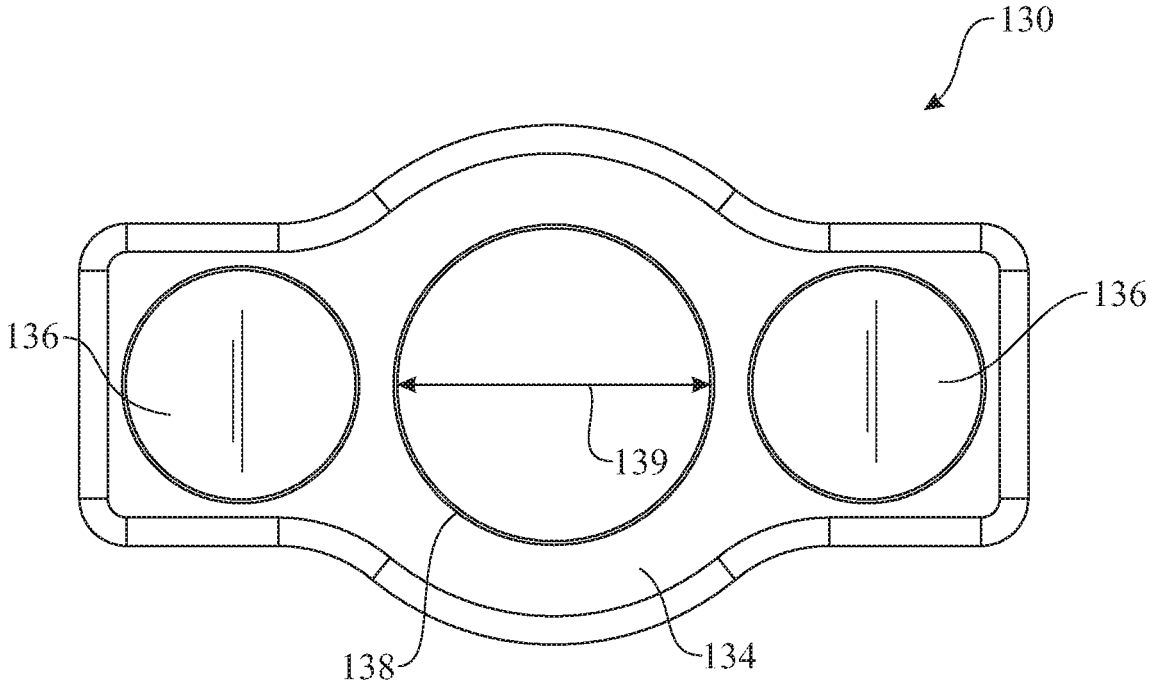
FIG. 3 presents an elevation of one illustrative embodiment of a docking unit showing an active dock surface, in accordance with the present invention.
Figure 4:
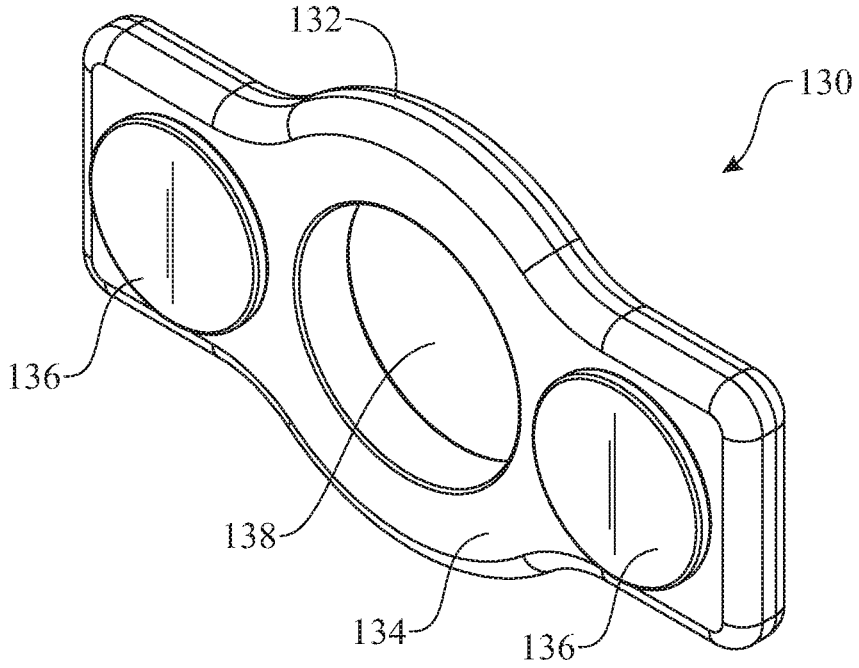
FIG. 4 presents a perspective view of the docking unit of FIG. 3, in accordance with the present invention.
Figure 5:
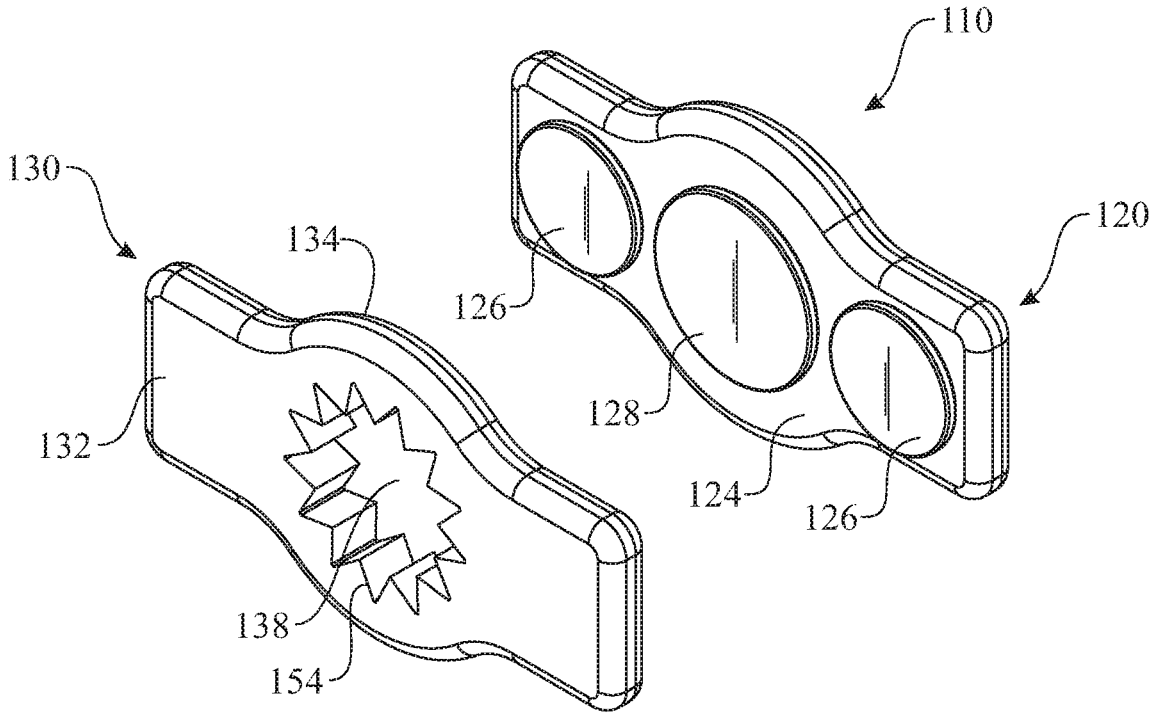
FIG. 5 presents a front perspective view of one illustrative embodiment of a docking assembly in a detached configuration, in accordance with the present invention.
Figure 6:
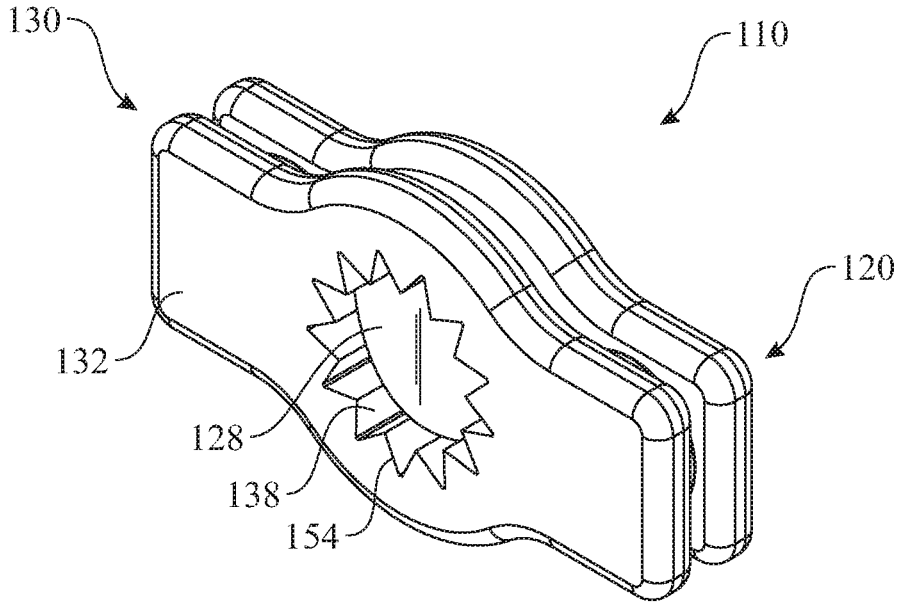
FIG. 6 presents a front perspective view of the docking assembly of FIG. 5 showing the base unit and the docking unit disposed in an operative alignment with one another, in accordance with the present invention.
Figure 7:
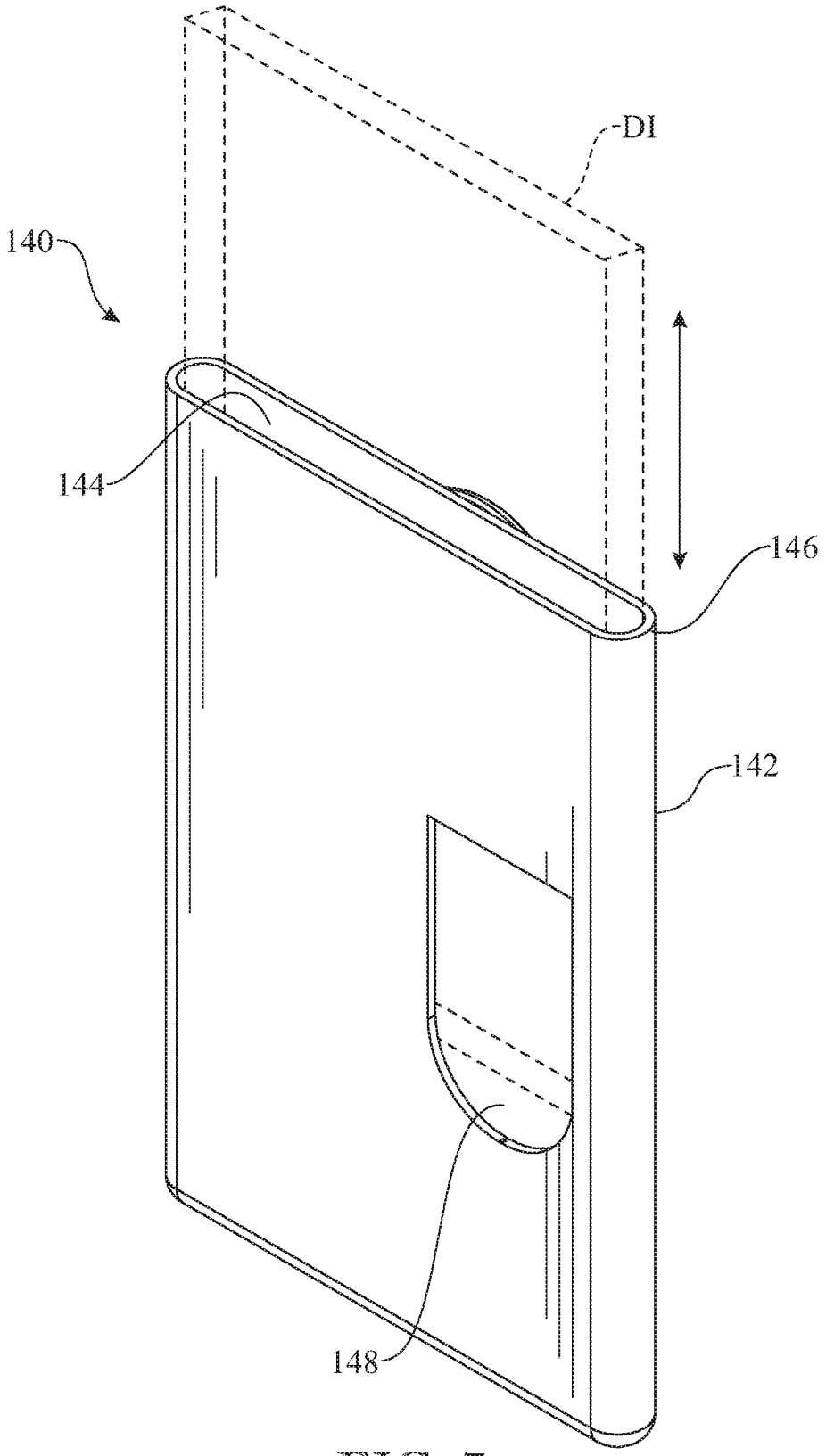
FIG. 7 presents a front perspective view of one illustrative embodiment of a display unit, in accordance with the present invention.

Turning to the illustrative embodiments of FIGS. 3 and 4, elevation and perspective views of a docking unit 130 in accordance with the present invention are shown. FIGS. 3 and 4 illustrate an embodiment of a docking unit 130 having an active docking surface 134. With reference to FIGS. 5 and 6, a docking unit 130 in accordance with one embodiment of the present invention further comprises a shielded docking surface 132. A docking unit 130 in accordance with at least one embodiment of the present invention includes at least one base interconnect 136 affixed thereto. More in particular, a docking unit 130 in accordance with the present invention includes at least one base interconnect 136 which is operative with at least one dock interconnect 126 of the base unit 120, such that the base unit 120 and the docking unit 130 of the docking assembly 110 may be removably attached to an article of clothing in a nondestructive manner. With reference once again to the illustrative embodiments of FIGS. 3 and 4, a docking unit 130 in accordance with at least one embodiment of the present invention comprises a plurality of base interconnects 136 affixed to an active docking surface 134. With continued reference to FIGS. 3 and 4, a docking unit 130 in accordance with the present invention further comprises a docking aperture 138.

As noted above, in accordance with at least one embodiment of the present invention, a docking unit 130 includes at least one base interconnect 136 which is operative with at least one dock interconnect 126 of the base unit 120, such that the base unit 120 and the docking unit 130 of the docking assembly 110 may be removably attached to an article of clothing in a nondestructive manner. In at least one further embodiment, a docking unit 130 comprises a plurality of base interconnects 136 which are operative with corresponding ones of a plurality of dock interconnects 126 of the base unit 120, once again, such that the base unit 120 and the docking unit 130 of the docking assembly 110 may be removably attached to an article of clothing in a nondestructive manner.

Further, in at least one embodiment of the present invention, at least one dock interconnect 126 comprises a magnetic material of construction. In such an embodiment, at least one corresponding base interconnect 136 may comprise a metallic material of construction. As will be appreciated, the magnetic material of the at least one dock interconnect 126 will be magnetically attracted towards the metallic material of construction of a corresponding base interconnect 136 when the dock interconnect 126 and the base interconnect 136 are disposed in operative alignments with one another. In one further embodiment, at least one dock interconnect 126 and at least one base interconnect 136 each comprise a magnetic material of construction. In yet another embodiment, at least one dock interconnect 126 and/or at least one base interconnect 136 comprise a magnet. As will be further appreciated, the at least one dock interconnect 126 and the at least one base interconnect 136 will be magnetically attracted toward one another when disposed in an operative alignment with one another. An operative alignment as used herein between one or more dock interconnects 126 and one or more base interconnects 136 is at least partially defined by an interconnecting magnetic force between the dock interconnect(s) 126 and the base interconnect(s) 136 sufficient to releasably secure the docking assembly 110 to the article of clothing in a nondestructive manner, such as is illustrated in FIG. 10.

With reference once again to the illustrative embodiments of FIGS. 1 and 2, the base unit 120 comprises a plurality of dock interconnects 126. As further shown in the figures, the plurality of dock interconnects 126 are disposed on the active base surface 124 of the base unit 120, such that the attractive forces of the dock interconnects 126, by way of example only, magnetic forces, are directed outwardly from the active base surface 124 of the base unit 120. Conversely, the attractive forces of the plurality of dock interconnects 126 are minimized, if present at all, through the shielded base surface 122 of the base unit 120. As such, in at least one embodiment, a base unit 120 is constructed from a rigid or semi-rigid non-magnetic material of construction such as, by way of example only, plastic, fiberglass, ceramic, rubber, engineered composite materials, etc., just to name a few.

Similarly, and with reference to the illustrative embodiments of FIGS. 3 and 4, the docking unit 130 comprises a plurality of base interconnects 136. As also shown in the figures, the plurality of base interconnects 136 are disposed on the active dock surface 134 of the docking unit 130, such that the attractive forces of the base interconnects 136, once again, by way of example only, magnetic forces, are directed outwardly from the active docking surface 134 of the base unit 120. Conversely, the attractive forces of the plurality of base interconnects 136 are minimized, if present at all, through the shielded docking surface 132 of the docking unit 130. Thus, as with the base unit 120, in at least one embodiment a docking unit 130 is constructed from a rigid or semi-rigid non-magnetic material of construction such as, by way of example only, plastic, fiberglass, ceramic, rubber, engineered composite materials, etc., just to name a few.

It will be appreciated by those of skill in the art that in at least one embodiment of the present invention, a plurality of dock interconnects 126 may present a common magnetic polarity, whether positive or negative, outwardly from an active base surface 124 of the base unit 120, while a plurality of base interconnects 136 may present a common but opposite magnetic polarity, once again, whether positive or negative, outwardly from an active docking surface 124 of the docking unit 130. As such, when the dock interconnects 126 on the base unit 120 are positioned in proximity to the base interconnects 136 on the docking unit 130, such as is shown best in FIGS. 5 and 8, respectively, interconnecting magnetic forces will act to operatively align and draw the plurality of dock interconnects 126 and the plurality of base interconnects 136 towards one another, and further, the interconnecting magnetic forces will act to maintain the base unit 120 and the docking unit 130 removably attached to one another, as shown best in FIGS. 6, 9 and 10. Further, in accordance with at least one embodiment of the present invention, the interconnecting magnetic forces between the dock interconnect(s) 126 and base interconnect(s) 136 maintain the base unit 120 and the docking unit 130 removably attached to one another while on opposite sides of an article of clothing "AC", such that the docking assembly 110 may be removably attached to the article of clothing "AC" in a nondestructive manner, once again, as shown best in the illustrative embodiment of FIG. 10.

While as described herein as comprising magnetic materials and/or magnets themselves, it will be appreciated by those of skill in the art the dock interconnect(s) 126 and base interconnect(s) 136 in accordance with the present invention may be operative utilizing other nondestructive attractive forces such as, by way of example only, electrical forces, electromagnetic forces, gravitational forces, molecular forces, etc.

Turning next to the illustrative embodiments of FIGS. 7 through 10, a nondestructive wearable detachable display assembly 100 in accordance with the present invention further comprises a display unit 140. A display unit 140 comprises a display holder 142 having a display chamber 144 which is dimensioned to support at least one display item "DI" therein in a visually prominent orientation. In at least one embodiment, a display holder 142 comprises a display chamber 144 which is dimensioned to support a plurality of display items "DI" therein wherein at least one of the plurality of display items "DI" is supported in a visually prominent orientation. In at least one embodiment, a display item "DI" comprises an identification card or identification badge, such as are commonly required to be carried or worn by personnel in any of a variety of work environments. Of course, a display item "DI" may comprise any of a number of other items a person may wish to display on his or herself, such as, a name tag, an organizational affiliation, a color code utilized to identify members of a particular group, etc.

As such, in accordance with at least one embodiment of the present invention a display holder 142 comprises an at least partially transparent or translucent material of construction. More in particular, at least an outwardly facing surface of a display holder 142 comprises at least partially transparent or translucent material of construction such that a display item "DI" supported therein is visible there through. In one further embodiment, a display holder 142 is constructed of a rigid or semi-rigid non-magnetic material of construction such as, by way of example only, plastic, fiberglass, ceramic, rubber, engineered composite materials, etc., just to name a few.

A display holder 142 in accordance with at least one embodiment of the present invention further comprises an access slot 146 disposed in communication with at least a portion of a display chamber 144. As shown best in the illustrative embodiment of FIG. 7, an access slot 146 is disposed in communication with a portion of the display chamber 144 and further, the access slot 146 is dimensioned to facilitate insertion or removal of at least one display item "DI" into and out of the display chamber 144, as demonstrated by the directional arrow in FIG. 7. In still one further embodiment of the present invention, a display unit 140 further comprises an access opening 148 disposed through at least a portion of the display holder 142 and into a display chamber 144. With reference once again to the illustrative embodiment of FIG. 7, an access opening 148 is dimensioned to allow a user to insert his or her finger or similarly sized object, for example, a portion of a pencil or pen, through the access opening 148 in order to assist positioning one or more display item "DI" into or out of display chamber 144 of the display holder 142.

It is to be appreciated that in at least one embodiment, a display chamber 144 may comprise a substantially or completely sealed configuration having at least one display item "DI" supported therein such that it may be displayed in a visually prominent orientation.

As previously stated, in at least one embodiment a base unit 120 further comprises a display interconnect 128. As also previously noted, a docking unit 130 in accordance with at least one embodiment of the present invention comprises a docking aperture 138. As shown in the illustrative embodiments of FIGS. 1 through 4, each of the display interconnect 128 of the base unit 120 and the docking aperture 138 of the docking unit 130 comprise a generally circular configuration. In at least one embodiment, a docking aperture 138 comprises a docking diameter 139, such as is shown in FIG. 3, which is at least slightly greater than a display interconnect diameter 129, as shown in FIG. 1, such that when one or more dock interconnect 126 are operatively aligned with one or more corresponding base interconnects 136, at least a portion of the display interconnect 128 of the base unit 120 will be received within docking aperture 138 of the docking unit 130. In one embodiment, a display interconnect 128 of a base unit 120 may comprise a truncated cone configuration while a docking aperture 138 of a docking unit 130 comprises a complementary and oppositely disposed truncated cone configuration so as to facilitate disposition of at least a portion of the display interconnect 128 into a portion of the docking aperture 138. In at least one further embodiment, a display interconnect 128 does not extend outwardly from an active base surface 124 more than one or more dock interconnects 126 extend outwardly from the active base surface 124. Thus, in such an embodiment, the display interconnect 128 is not received in any portion of the docking aperture 138, rather, the display interconnect merely overlies at least a portion of one side of the docking aperture 138 such that the attractive forces of the display interconnect 128 may pass there through unobstructed.

Turning next to the illustrative embodiment of FIG. 8, the display unit 140 further comprises a docking interconnect 150 affixed to a portion of the display unit 142. As further shown in FIG. 8, the docking interconnect 150 comprises a generally circular configuration, similar to display interconnect 128 of the base unit 120, such as shown in, by way of example in the illustrative embodiments of FIGS. 1 and 2. In operation, a display unit 142 is attachable to and detachable from a docking assembly 110 of the present invention with a single hand of the user as a result of an operative engagement of at least one docking interconnect 150 and at least one display interconnect 128.

More in particular, in at least one embodiment of the present invention, at least one display interconnect 128 comprises a magnetic material of construction, and a corresponding docking interconnect 150 comprises a metallic material of construction. As will be appreciated, the magnetic material of the at least one display interconnect 128 will be magnetically attracted towards the metallic material of construction of a corresponding docking interconnect 150 when the display interconnect 128 and the docking interconnect 150 are disposed in an operative alignment with one another, such as is partially demonstrated in FIG. 8. In one further embodiment, at least one display interconnect 128 and at least one docking interconnect 150 each comprise a magnetic material of construction. In yet another embodiment, at least one display interconnect 128 and/or at least one docking interconnect 150 comprise a magnet. As will be further appreciated, the display interconnect 128 and the docking interconnect 150 will be magnetically attracted toward one another when disposed in an operative engagement with one another, once again, as is partially illustrated in FIG. 8.

As such, in at least one embodiment, an operative engagement of at least one docking interconnect 150 with at least one display interconnect 128 disposed on a base unit 120 of a docking assembly 110 occurs when the docking interconnect 150 of the display unit 140 is positioned proximate the docking aperture 138 of a docking unit 130, while the docking unit 130 is disposed in an operative alignment with a base unit 120 comprising a display interconnect 128. In one further embodiment, as used herein, an operative engagement of at least one docking interconnect 150 and at least one display interconnect 128 is at least partially defined by a docking magnetic force between the docking interconnect 150 and the display interconnect 128 sufficient to releasably attach the display unit 140 to the docking assembly 110, with a single hand, thereby disposing at least one display item "DI" in a visually prominent orientation.

With continued reference to FIG. 8, a docking interconnect 150 further comprises a display alignment number 152 disposed there around. In at least one embodiment, a display alignment member 152 comprises a geometric configuration. In at least one further embodiment, a docking aperture 138 of a docking unit 130 comprises a display alignment guide 154 which also comprises a geometric configuration. As shown in the illustrative embodiment of FIG. 8, the display alignment member 152 comprises a star-like geometric configuration and the docking aperture 138 of the base unit 130 comprises a display alignment guide 154 also comprising a complementary star-like geometric configuration. As such, the display alignment member 152 of the display unit 140 may engage the display alignment guide 154 of the docking aperture 138 of docking unit 130 in any of a variety of aligned configurations such that the display holder 142 of the display unit 140 may be disposed in any of a variety of display orientations relative to the docking unit 130 of the display assembly 110. More in particular, as shown in the illustrative embodiments of FIGS. 8 and 9, the display holder 142 of the display unit 140 is disposed in an aligned configuration wherein the access slot 146 is in an upwardly facing direction. However, it will be appreciated that the display holder 142 may be disposed in an aligned configuration wherein the access slot 146 is in a downwardly facing direction. Alternatively, the display holder 142 may be disposed in an aligned configuration wherein the access slot 146 is in a sideward facing direction, either left or right, or any of a number of positions in between, limited only by the number of points in the star-like geometric configuration of the display alignment member 152 and the display alignment guide 154.

It will also be appreciated that in at least one further embodiment, a display alignment member 152 and a display alignment guide 154 may comprise complementary geometric configurations such that only one aligned configuration exists such as, by way of example only, complementary trapezoidal configurations. In still one further embodiment, a display alignment member 152 and a display alignment guide 154 may comprise complementary geometric configurations such that only a very limited number of aligned configurations exist, such as, by way of example only, complimentary rectangular, equilateral triangular, square, or hexagonal configurations.

As will be further appreciated, in an embodiment wherein the docking aperture 138 and the docking interconnect 150 each comprise a simple circular configuration, display holder 142 may be rotated a full 360 degrees in either direction, thereby disposing the display holder into any of a plurality of aligned configurations, as may be desired.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A display assembly supports at least one display item in a visually prominent orientation and is removably attachable to an article of clothing worn by a user in a nondestructive manner, the article of clothing having an inner surface and an outer surface, said display assembly comprising:

a docking assembly comprising a base unit having at least one dock interconnect and at least one display interconnect;

said docking assembly further comprising a docking unit having at least one base interconnect;

said docking assembly removably attached to the article of clothing in said nondestructive manner via an operative alignment of said at least one dock interconnect and said at least one base interconnect;

a display unit comprising a display holder having a display chamber dimensioned to support the at least one display item in said visually prominent orientation; and said display unit also including at least one docking interconnect, said display unit attachable to and detachable from said docking assembly with a single hand of the user via an operative engagement of said at least one docking interconnect with said at least one display interconnect of said docking assembly.

2. The display assembly as recited in claim 1 wherein said base unit is positioning on the inner surface of the article of clothing and said docking unit is positioned on the other surface of the article of clothing proximate said base unit.

3. The display assembly as recited in claim 2 wherein said at least one dock interconnect comprises a magnetic material of construction.

4. The display assembly as recited in claim 3 wherein said at least one base interconnect comprises a magnetic material of construction.

5. The display assembly as recited in claim 4 wherein said operative alignment of said at least one dock interconnect and said at least one base interconnect is at least partially defined by an interconnecting magnetic force between said at least one dock interconnect and said at least one base interconnect sufficient to releasably secure said docking assembly to the article of clothing in said nondestructive manner.

6. The display assembly as recited in claim 1 wherein said at least one docking interconnect comprises a magnetic material of construction.

7. The display assembly as recited in claim 6 wherein said at least one display interconnect comprises a magnetic material of construction.

8. The display assembly as recited in claim 7 wherein said operative engagement of said at least one docking interconnect and said at least one display interconnect is at least partially defined by a docking magnetic force between said at least one docking interconnect and said at least one display interconnect sufficient to releasably attach said display unit to said docking assembly, thereby disposing the at least one display item in said visually prominent orientation.

9. The display assembly as recited in claim 1 wherein said display unit further comprises a display alignment member disposed around at least a portion of said at least one docking interconnect.

10. The display assembly as recited in claim 9 wherein said display alignment member comprises a geometric configuration.

11. The display assembly as recited in claim 10 wherein said docking aperture comprises a display alignment guide channel, said display alignment guide channel comprising a complementary geometric configuration dimensioned to receive said display alignment member therein in at least one aligned configuration.

12. The display assembly as recited in claim 10 wherein said docking aperture comprises a display alignment guide channel, said display alignment guide channel comprising a complementary geometric configuration dimensioned to receive said display alignment member therein in any of a plurality of aligned configurations.

13. The display assembly as recited in claim 1 wherein said display unit further comprise an access slot disposed in communication with said display chamber, said access slot dimensioned to permit insertion of the at least one display item into said display chamber and removal of the at least one display item from said display chamber.

14. The display assembly as recited in claim 13 wherein said display unit further comprises an access opening through a portion of said display holder and into said display chamber to facilitate insertion and removal of the at least one display item into and from said display chamber, respectively.

15. A display assembly supports at least one display item in a visually prominent orientation and is removably attachable to an article of clothing worn by a user in a nondestructive manner, the article of clothing having an inner surface and an outer surface, said display assembly comprising:

a docking assembly comprising a base unit having a plurality of dock interconnects and at least one display interconnect;

said docking assembly further comprising a docking unit having a plurality of base interconnects;

said docking assembly removably attached to the article of clothing in said nondestructive manner via an operative alignment of said plurality of dock interconnects and said plurality of base interconnects;

a display unit comprising a display holder having a display chamber to support the at least one display item in said visually prominent orientation; and said display unit also including at least one docking interconnect, said display unit attachable to and detachable from said docking assembly with a single hand of the user via an operative engagement of said at least one docking interconnect with said at least one display interconnect.

16. The display assembly as recited in claim 15 wherein each of said plurality of dock interconnects or each of said plurality of base interconnects comprises a magnet.

17. The display assembly as recited in claim 16 wherein said operative alignment of said plurality of dock interconnects and said plurality of base interconnects is at least partially defined by an interconnecting magnetic force between said plurality of dock interconnects and said plurality of base interconnects sufficient to releasably secure said docking assembly to the article of clothing in said nondestructive manner.

18. The display assembly as recited in claim 15 wherein said at least one display interconnect or said at least one docking interconnect comprises a magnet.

19. The display assembly as recited in claim 18 wherein said operative engagement of said at least one docking interconnect and said at least one display interconnect is at least partially defined by a docking magnetic force between said at least one docking interconnect and said at least one display interconnect sufficient to releasably attach said display unit to said docking assembly, thereby disposing the at least one display item in said visually prominent orientation.

20. A display assembly supports at least one display item in a visually prominent orientation and is removably attachable to an article of clothing worn by a user in a nondestructive manner, the article of clothing having an inner surface and an outer surface, said display assembly comprising:

a docking assembly including a base unit having a plurality of dock interconnects and a display interconnect, said dock interconnects and said display interconnect comprising magnets;

said docking assembly further comprising a docking unit having a plurality of base interconnects, said base interconnects comprising magnets;

said docking assembly removably attached to the article of clothing in said nondestructive manner via an operative alignment of said plurality of dock interconnects with said plurality of base interconnects, said operative alignment of said plurality of dock interconnects and said plurality of base interconnects is at least partially defined by interconnecting magnetic forces between magnetically aligned ones of said plurality of dock interconnects and said plurality of base interconnects sufficient to releasably secure said docking assembly to the article of clothing in said nondestructive manner;

a display unit comprising a display holder having a display chamber to support the at least one display item in said visually prominent orientation; and said display unit also including a docking interconnect comprising a magnet, said display unit attachable to and detachable from said docking assembly with a single hand of the user via an operative engagement of said docking interconnect with said display interconnect, said operative engagement of said docking interconnect and said display interconnect is at least partially defined by a docking magnetic force between said docking interconnect and said display interconnect sufficient to releasably attach said display unit to said docking assembly, thereby disposing the at least one display item in said visually prominent orientation.

* * * * *